United States Patent [19]

Genevase

[11] 4,123,973

[45] Nov. 7, 1978

[54] BROCADE TOOL

[76] Inventor: Frank O. Genevase, 10708 NE. 15th St., Vancouver, Wash. 98664

[21] Appl. No.: 777,832

[22] Filed: Mar. 15, 1977

[51] Int. Cl.[2] ..... B41K 1/28

[52] U.S. Cl. ..... 101/379; 101/368; 101/406; 15/235.3; 427/280; 401/118

[58] Field of Search ..... 101/327, 368, 372, 379, 101/405, 406; 15/235.3, 235.4, 235.8; 427/277, 280, 288; 401/9, 118, 130

[56] References Cited

U.S. PATENT DOCUMENTS

| | | | |
|---|---|---|---|
| 1,238,229 | 8/1917 | Weiler | 101/368 |
| 2,835,196 | 5/1958 | Herbert et al. | 101/405 |
| 3,180,260 | 4/1965 | Joseph | 101/379 |
| 3,269,309 | 8/1966 | Munson | 101/406 |
| 3,446,143 | 5/1969 | Williamson | 101/379 |
| 3,817,178 | 6/1974 | Hagen | 101/379 |
| 4,030,414 | 6/1977 | McGuire | 101/379 |

FOREIGN PATENT DOCUMENTS

| | | | |
|---|---|---|---|
| 474,991 | 3/1915 | France | 101/406 |
| 296,275 | 8/1928 | United Kingdom | 101/406 |

*Primary Examiner*—William Pieprz
*Attorney, Agent, or Firm*—Eugene M. Eckelman

[57] ABSTRACT

A tool for making designs on surfaces such as ceilings. It comprises a head and a handle therefor. The head is formed into the desired pattern and the material applying surfaces thereof have resiliency for efficient operation on an uneven surface. The head may have a flexible connection to the handle to provide good surface engagement by the head even though the tool is tilted relative to the surface.

3 Claims, 7 Drawing Figures

BROCADE TOOL

BACKGROUND OF THE INVENTION

This invention relates to a new and novel tool for applying ornamental designs to surfaces.

Various ceiling designs have been employed in the art. Some of the methods of making such designs comprise pressing a wad of paste-like material onto the surface and either leaving the design as is or troweling it smooth. Such requires a certain amount of experience and furthermore even with an experienced workman, a uniform pattern annot adequately be provided.

Devices have heretofore been employed, such as shown in U.S. Pat. No. 437,112, for making textures by the use of a tool working with a paste-like material. Or, as shown in U.S. Pat. No. 1,868,013, a trowel is employed for making an ornamentation surface for walls. These tools, as well as other tools which have been used in the trade, are not capable of simultaneously applying the material to a surface and of making a uniform pattern.

SUMMARY OF THE INVENTION

According to the present invention and forming a primary objective thereof, a tool is provided which is used to apply a paste-like material to a ceiling or wall surface and at the same time provide a decorative arrangement of the material.

Another object is to provide a tool of the type described which facilitates the application of a paste-like material on a surface without the necessity of the workman having much experience.

Still another object is to provide a tool of the type described wherein the head portion for applying the paste-like material has a resilient covering, and further yet a flexible connection is provided between the head and a handle, such resilient head structure and resilient connection between the head and the handle providing for uniform application to a surface even though the surface is not perfectly flat and even though the head is brought into engagement with the surface in tilted relation.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figure 1:
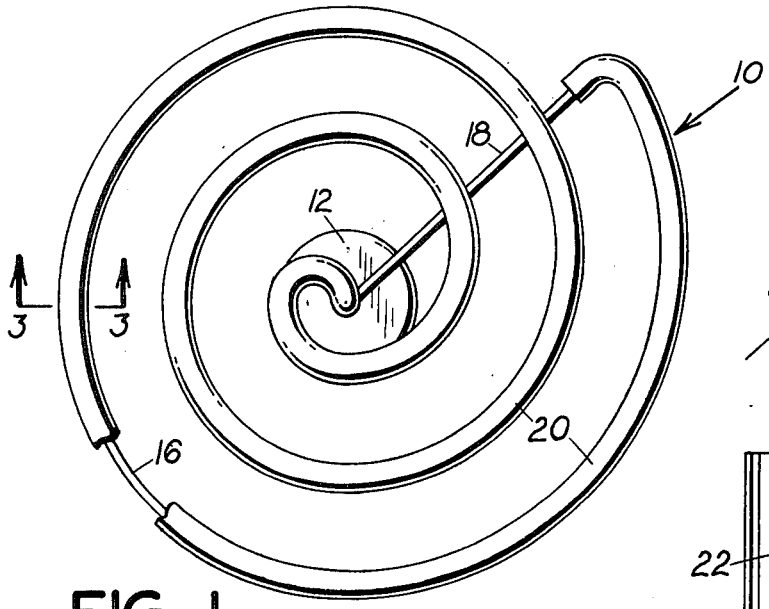
FIG. 1 is a plan view, partly broken away, of a tool comprising a first embodiment of the invention.
Figure 3:
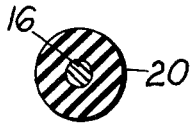
FIG. 3 is an enlarged fragmentary sectional view taken on the line 3—3 of FIG. 1.
Figure 2:
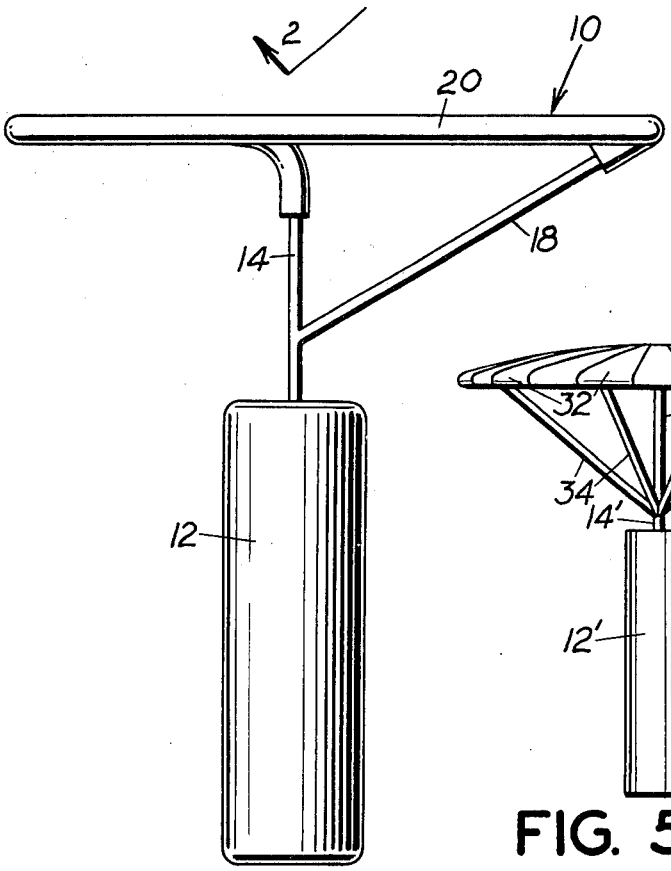
FIG. 2 is a side elevational view of the tool of FIG. 1, taken on the line 2—2 of FIG. 1.

With particular reference to FIGS. 1, 2 and 3, one embodiment of the tool comprises in general a head 10 and a handle 12. The embodiment of FIG. 1 illustrates one form of tool design wherein the head 10 is constructed of a spiral shape and is thus capable of applying spiral patterns. In such structure, a substantially heavy gauge wire forms the frame of the head and in its structure has a stem portion 14 which leads upwardly from an integral connection with the handle to a spiral portion 16. In the structure shown, the stem 14 leads into the center portion of the spiral and at the outer or end portion of the spiral, the wire is bent into a radially and downwardly angled brace portion 18. The brace portion 18 is secured, as by welding to the stem 14.

The wire portion 16 of the head has a resilient covering 20. As best seen in FIG. 3, this covering has substantial thickness. Essentially, it is desired that the covering be at least on the upper side of the head, although for convenience in manufacture the covering may completely encircle the wire 16. The wire which is used to form the stem 14 and the head portion 16, while having sufficient rigidity to support the head, has some flexibility so that the various convolutions in the spiral shaped head can flex slightly relative to each other. Furthermore, the stem 14 provides some flexibility of the head on the handle and allows automatic adjustment as will be more apparent hereinafter.

In the operation of the present tool, it is inverted and dipped a shallow distance in a supply of a paste-like material which is to be applied to a surface. A supply of the material sticks on the head portions and is transferred to the surface by pressing it thereagainst. The design of material transferred to the surface corresponds to the design shape of the head.

With the use of the resilient covering 20 of the head portion 16, as well as the flexibility of the various convolutions in the head, the transfer of material to the surface will be substantially uniform even though slight irregularities may exist in the surface. Furthermore, since the head can flex slightly relative to the handle, the entire head will lie flat on the surface to be decorated even though the operator does not precisely bring the tool up flat against the surface.

Figure 4:
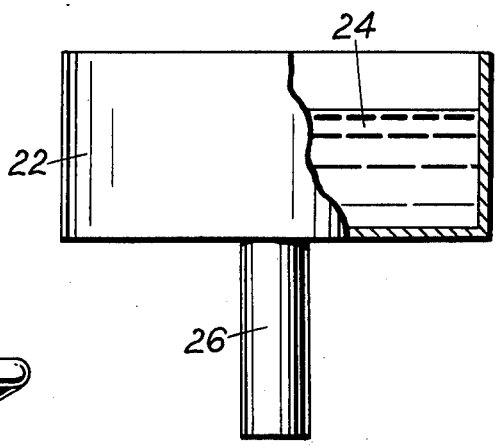
FIG. 4 is a side elevational view, partly broken away, of a container adapted for use with the present tool to supply a paste-like material to the tool.

FIG. 4 shows a container 22 for holding a batch of paste-like material 24. This container has an open top and a depending handle 26, and for charging the tool with material to be applied to the surface, the tool is merely dipped into the material 24 in the container.

Figure 5:
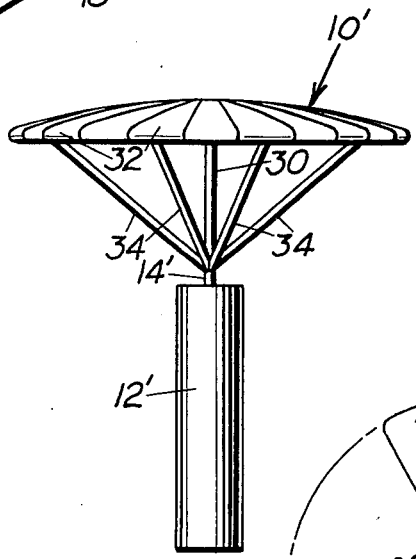
FIG. 5 is a side elevational view of a second embodiment of tool.
Figure 6:
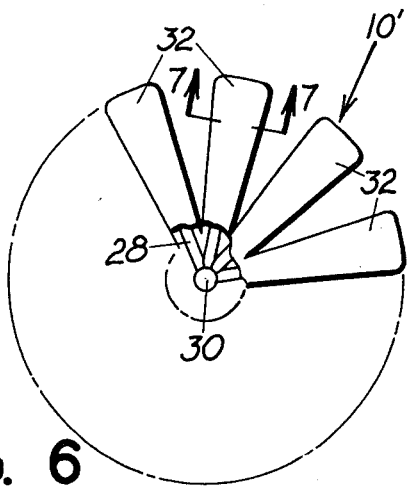
FIG. 6 is a plan view thereof.
Figure 7:
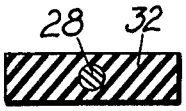
FIG. 7 is an enlarged fragmentary sectional view taken on the line 7—7 of FIG. 6.

FIGS. 5, 6 and 7 show an alternate form of the construction and primarily illustrates that the head portion of the tool may assume different shapes for making different patterns. This embodiment similarly has a head 10', a handle 12', and a stem 14' which supports the head on the handle. In this embodiment a plurality of radial wire extensions 28 lead from a center base portion 30 and support resilient fingers 32 which taper to a greater width toward their outer end. This design provides a petal-like design and illustrates primarily that the tool may be constructed in different patterns. Many different patterns may be utilized.

The extensions 28 shown in FIGS. 5–7 have angled braces 34 for support. Each extension has one of these braces extending from the lower portion thereof and from between its ends down to the stem 14'. The construction of the stem 14' and extensions 28 provide some flexibility of the head relative to the handle so that it will automatically adjust to a flat position against a surface even though the operator may bring the tool in slightly tilted. Also, as seen in FIG. 5, the extensions 28 and their resilient fingers 32 angle downward slightly toward the outside to provide a slight flexibility between the individual portions of the head. The flexibility of the fingers allows the outer ends thereof to come up to the same plane as the inner ends of the fingers by slight pressure of the tool on the surface. This flexibility provides for uniform engagement of a surface which may be slightly irregular.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A tool for picking up a paste-like material and applying such material to a surface for making a design on said surface, said tool comprising (a) a handle having upper and lower ends, (b) a wire stem projecting longitudinally from the upper end of said handle, (c) and a head on the upper end of said stem, (d) said head being constructed of wire and having an extension integral with said stem and forming a a selected decorative pattern, (e) said extension having a resilient covering forming a decorative pattern corresponding to the wire pattern of the head, which resilient covering comprises a material applying surface of said tool, (f) said stem and extension being flexible to provide angular adjustment of said head relative to said handle and together with said resilient covering conforms to irregularities in the surface to which material is being applied.

2. The tool of claim 1 wherein said extension comprises a spiral loop.

3. The tool of claim 1 wherein said extension comprises radially extending fingers.

* * * * *